United States Patent [19]

Igashira et al.

[11] Patent Number: 4,514,657

[45] Date of Patent: Apr. 30, 1985

[54] SPARK PLUG HAVING DUAL GAPS FOR INTERNAL COMBUSTION ENGINES

[75] Inventors: Toshihiko Igashira, Toyokawa; Toru Yoshinaga, Okazaki, both of Japan

[73] Assignee: Nippon Soken, Inc., Nishio, Japan

[21] Appl. No.: 257,135

[22] Filed: Apr. 24, 1981

[30] Foreign Application Priority Data

| | | | |
|---|---|---|---|
| Apr. 28, 1980 | [JP] | Japan | 55-56920 |
| Jul. 3, 1980 | [JP] | Japan | 55-91448 |
| Nov. 11, 1980 | [JP] | Japan | 55-158957 |
| Nov. 11, 1980 | [JP] | Japan | 55-158958 |
| Nov. 25, 1980 | [JP] | Japan | 55-165460 |
| Dec. 1, 1980 | [JP] | Japan | 55-169399 |

[51] Int. Cl.[3] ..... H01T 13/20; H01T 13/32

[52] U.S. Cl. ..... 313/130; 313/141

[58] Field of Search ..... 313/130, 141, 142, 141.1

[56] References Cited

U.S. PATENT DOCUMENTS

| | | | |
|---|---|---|---|
| 2,391,456 | 12/1945 | Hensel | 313/141.1 X |
| 2,642,053 | 6/1953 | Dowson | 313/141.1 |
| 2,900,547 | 8/1959 | Engel | 313/142 X |
| 3,673,452 | 6/1972 | Brennen | 313/141 X |
| 3,854,067 | 12/1974 | Morgan | 313/130 |
| 3,872,338 | 3/1975 | Wax | 313/141 X |
| 3,921,020 | 11/1975 | Wax | 313/141 X |
| 4,122,366 | 10/1978 | von Stutterheim et al. | 313/141 |
| 4,331,899 | 5/1982 | Nishida et al. | 313/142 X |

FOREIGN PATENT DOCUMENTS

| | | | |
|---|---|---|---|
| 2256823 | 6/1974 | Fed. Rep. of Germany | 313/141 |

OTHER PUBLICATIONS

*Modern Ceramics, Some Principles and Concepts,* Edited by Hove and Riley, 1965, p. 83.

*Primary Examiner*—Palmer Demeo
*Assistant Examiner*—Sandra L. O'Shea
*Attorney, Agent, or Firm*—Cushman, Darby & Cushman

[57] ABSTRACT

A spark plug for spark ignition type internal combustion engines includes an earth electrode formed of a heat-resisting metal, a central electrode, and a supplementary electrode provided on the earth electrode or the tip end of the central electrode. The supplementary electrode cooperates with one of the other electrodes to define therebetween a spark gap which is smaller in dimension than the normal spark gap defined between the earth and central electrodes. The supplementary electrode has a higher specific resistance than that of the earth electrode.

13 Claims, 32 Drawing Figures

SPARK PLUG HAVING DUAL GAPS FOR INTERNAL COMBUSTION ENGINES

BACKGROUND OF THE INVENTION

This invention relates to spark plugs for spark ignition type internal combustion engines, and more particularly to spark plugs having dual gaps.

In recent years, concerns have been increasing about environmental pollution due to exhaust gases discharged from automobiles and about the nursing of resources, and from this point of view spark plugs for use with internal combustion engines of automobiles have been increasingly required to be improved in performance. As countermeasures therefor, there has been proposed to enlarge a discharging gap as much as possible for the improvement of ignition performance, or to drop discharge voltage demand as much as possible for simplification of discharge devices, or to reduce changes in discharge voltage demand for increased reliability. However, these respective measures tend to be inconsistent with one another. More specifically, large discharge gaps necessitate high discharge voltages. On the other hand, thinner electrodes necessitate lower discharge voltages, but they are subject to severe consumption resulting in a large change of the discharge voltage with the passage time. In this regard, tips of electrodes can be made of gold or platinum which are hard to be consumed, but are costly.

SUMMARY OF THE INVENTION

The spark plug of this invention has improved ignition characteristics in ensuring ignition of the mixture of fuel and air.

It is an object of the invention to satisfy the contradictory requirements of enlarging a discharge gap as much as possible for the improvement of ignition performance and decreasing a discharge voltage demand as much as possible for simplification of discharge devices.

It is another object of the invention to stabilize a discharge demand over a long period of time.

To this end, there are provided small and large gaps according to the invention which small gap is used at the beginning of discharge, i.e. breakdown to enable reducing the discharge voltage demand and which large gap is used for the subsequent electric discharge. According to the invention, only electrodes constituting the large gap are consumed so as to reduce consumption of electrodes constituting the small gap which controls the discharge voltage demand.

This invention provides a spark plug in which projections having a larger specific resistance than that of a base portion of the earth or grounded electrode are disposed in opposed relationship with the central electrode to provide small and large discharge gaps and in which upon breakdown the small gap located between the projections and the central electrode is used to make the required electric voltage and thereafter electric discharge is caused to occur at the large gap located between the base portion of the earth electrode and the central electrode.

According to the invention, a rod body formed of a heat-resistant metal has secured at its tip end a tip which is formed of a conductive ceramic having larger heat-resistance and electric resistance than those of the rod body and is smaller in diameter than the rod body, so that spark discharge is started at the tip and the discharge voltage becomes low to lessen the burden on the associated ignition system and to reduce consumption of the central electrode. In the invention, spark discharge is started at the tip and is immediately moved to the tip end of the rod body, so that consumption of the tip is further reduced conjointly with the fact that the tip is formed of ceramic materials.

According to the invention, the electrode member constituting the small gap is provided on the earth electrode, so that even if it were formed of low heat conductive materials, heat is readily conducted from the electrode member to the housing to hardly cause trouble. It has been found that consumption is primarily produced on the surfaces of the central electrode and is reduced as the gap between the electrodes becomes large. In the invention, the large gap is large in magnitude to reduce consumption of the electrodes.

According to the invention, flame core produced at the supplementary spark discharge when spark discharge is moved thereto under sooty conditions can become large as compared with the prior art, so that ignition of the mixture is ensured and variation in combustion is reduced.

These and other objects of the invention will be more fully understood after consideration of the following description taken in connection with the accompanying drawings.

DESCRIPTION OF THE PREFERRED EMBODIMENT

Figure 1:
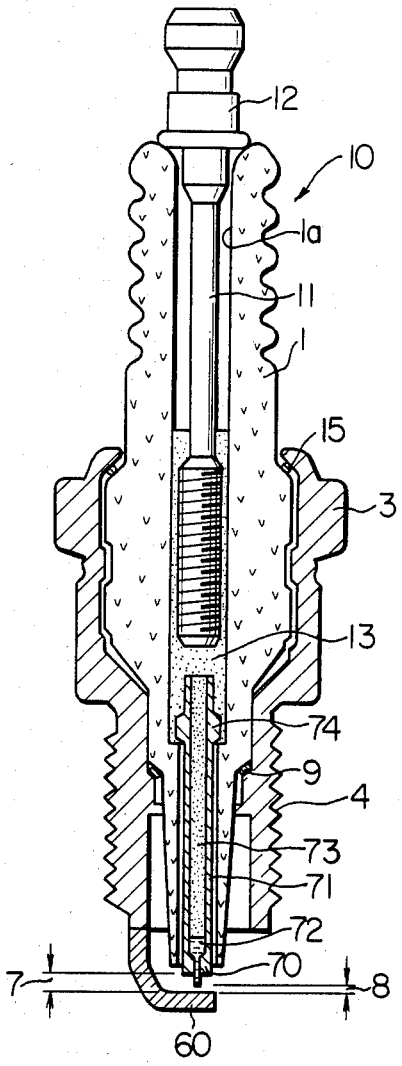
FIG. 1 is a vertical sectional view of a spark plug according to a first embodiment of the invention.

Referring now to FIG. 1, there is shown a spark plug 10 according to a first embodiment of the invention which includes an insulator 1 made of alumina porcelain, a metallic core shaft 11 extending through an upper portion of an axial bore 2 formed in the insulator 1, a terminal 12 threadedly fitted on the head of the core shaft 11, a cylindrical-shaped housing 3 made of a heat-resisting, anticorrosive, conductive metal, a central electrode 70, and a J-shaped earth electrode 60 made of a heat-resisting, anticorrosive, conductive metal and secured to the lower end of the housing 3 as by welding. The housing 3 secures thereto said insulator 1 by means of a ring-shaped air tight packing 9 and a caulking ring 15. The housing 3 is formed with a threaded portion 4 for securing the same to the cylinder block of the associated internal combustion engine. The central electrode 70 constituting the subject matter of the invention includes a rod-like casing 71 having a circular section and made of nickel alloy, a tip 72 formed of conductive ceramic consisting of TiC and $Al_2O_3$, a core rod 73 made of good heat conductive copper for adjustment of thermal equivalent. The casing 71 is cylindrical in shape, and has an outer diameter of 2.5 mm and an inner diameter of 1.6 mm with the lower end thereof having 0.9 mm. The casing 71 also has a large diameter portion 74 of a diameter of 4 mm near the top thereof. The tip 72 is in the form of a stepped circular rod, and its large diameter portion is received in a portion of the casing 71 having a larger inner diameter and its small diameter portion extends beyond the forward end of the casing 71 by about 0.8 mm. The core rod 73 is formed by filling the interior of the casing 71 with powdered copper in a manner to bear against the end face of the tip 72, melting the powdered copper and then solidifying the same.

The central electrode 70 extends through the lower portion of the axial bore 2 of the insulator 1, and the core rod 73 facilitates abating of heat.

A conductive layer 13 of a glass seal is constituted by copper powder and a low-melting-point glass, and is solidified in the axial bore 2 of the insulator 1. The layer 13 electrically connects the core shaft 11 with the central electrode 70, and secures both in the axial bore 2 of the insulator 1.

A discharge gap is defined between the end face of the central electrode 70 and the side surface of the earth electrode 60, and comprises a first gap 8 defined between the end face of the tip 72 and the earth electrode 60 and a second gap 7 defined between the end face of the casing 71 and the earth electrode 60. The first gap 8 has a thickness of about 0.7 mm and the second gap 7 has a thickness of about 1.5.

When a high electric voltage is applied across the discharge gap, spark discharge is firstly produced across the first gap 8. As the diameter of the tip 72 is small, for example, 0.9 mm, the voltage required for starting spark discharge is very low. In an experiment, the required voltage was 20 KV where the diameter of the tip was 2.5 mm, and was 14 KV where the diameter was 0.9 mm. Spark discharge produced at the first discharge gap 8 instantly generates a large amount of ions which facilitate spark discharge at the second discharge gap 7. Accordingly, spark discharge propagates to the second gap 7 and continues thereat. The reason for such propagation of spark discharge is that the tip 72 has an electric resistance of about 100 $\mu\Omega$/cm ($-10^{-6}$ ohms per cm) when formed by TiC and $Al_2O_3$, as in this embodiment, and the magnitude of the electric resistance is substantially larger than an electric resistance of the casing, that is, 7 $\mu\Omega$ cm when the latter is formed by Ni alloy. When a ratio in weight of TiC to $Al_2O_3$ in the tip 72 is 3:7, the electric resistance becomes 80000 $\mu\Omega$ cm, so that propagation of spark discharge to the second gap 7 is further promoted.

Referring now to FIGS. 2A to 4B, there is shown a spark plug 10A according to a second embodiment of the invention which includes an insulator 1 formed centrally with an axial bore 2, a housing 3 made of heat-resisting, anticorrosive, conductive metal and securing therein a central electrode 50, and an earth electrode 60 secured to said housing by welding. The housing 3 is formed with a threaded portion 4 for securing the same to the cylinder head of the associated internal combustion engine. The central electrode 50 comprises an outer section 51 made of Ni-Cr alloy having a good anticorrosivity and an inner section 52 made of copper having a good thermal conductivity. The earth electrode 60 includes a base portion 61 made of Ni and formed with a T-shaped groove 62 by machining, a projection 63 made of a ceramic of high specific resistance, such as Sic (silundum) and fitted into said T-shaped groove 62, and a member 64 made of Ni for mounting of said projection 63 and having the same sectional shape as that of the groove 62. After insertion of the projection 63 into the groove 62, the member 64 is adapted to be inserted into the groove 62 and welded to the base portion 61 thus securing the projection 63 to the base portion. The reference numeral 65 designates a weld. Alternatively, the member 64 may be dispensed with and the projection 63 may be secured in place by closing the opened end thereof by weld padding.

A large gap 7 is defined between the base portion 61 of the earth electrode 60 and the central electrode 50, and a small gap 8 is defined between the projection 63 and the central electrode 50.

Figure 2A:
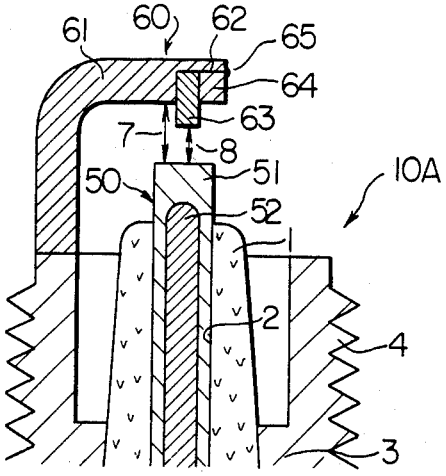
FIGS. 2A and 2B are fragmentary sectional views of a spark plug according to a second embodiment of the invention.
Figure 2B:
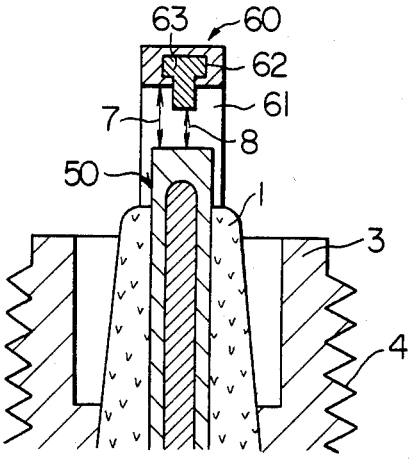
Figure 3A:
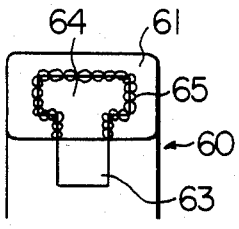
FIGS. 3A to 3C are sectional views of a part of the spark plug of FIG. 2A.
Figure 3B:
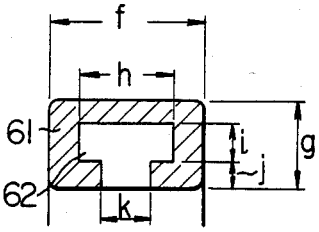
Figure 3C:
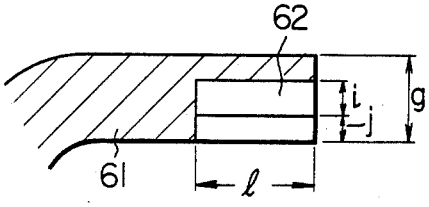
Figure 4A:
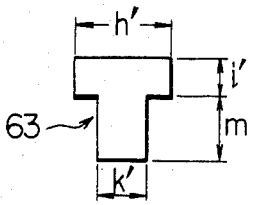
FIGS. 4A and 4B are front and side views of a part of the spark plug of FIG. 2A.
Figure 4B:
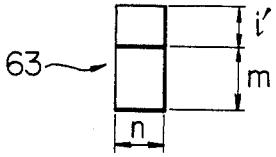

The base portion 61 of the earth electrode is shown in transverse section in FIG. 2A and shown in longitudinal section in FIG. 2B. In the drawings, the dimensions of the base portion 61 are represented by f=2.8 mm and g=1.4 mm. The dimensions of the T-shaped groove 62 are represented by h=1.6 mm, i=0.6 mm, j=0.5 mm and k=0.8 mm. The T-shaped groove 62 extends from the end of the base portion 61 by 1.2 mm. As shown in FIG. 4, the projection 63 is T-shaped and has dimensions represented by h'=1.6 mm, i'=0.6 mm, k'=0.8 mm, m=1.1 mm and n=0.8 mm. For example, the large gap 7 has a thickness of 1.5 mm and the small gap 8 has a thickness of 0.8 mm.

In operation of the second embodiment, the earth electrode 60 as described above is such that its base portion 61 has a specific resistance of 5 to 10 $\mu\Omega$ cm and the projection 63 has a specific resistance of 1 to 100 $\Omega$ cm. When a high electric voltage is applied between the central electrode 50 and the housing 3, breakdown occurs at the small gap 8 thus resulting in spark discharge between the projection 63 and the central electrode 50. The required breakdown voltage is 10 KV or more. After the occurrence of breakdown, electric discharge is maintained at several hundred volts, and immediately propagates itself onto the large gap 7. The reason for this is that the base portion 61 has a smaller specific resistance as compared with that of the projection 63, thus facilitating maintaining such electric discharge.

Figure 5A:
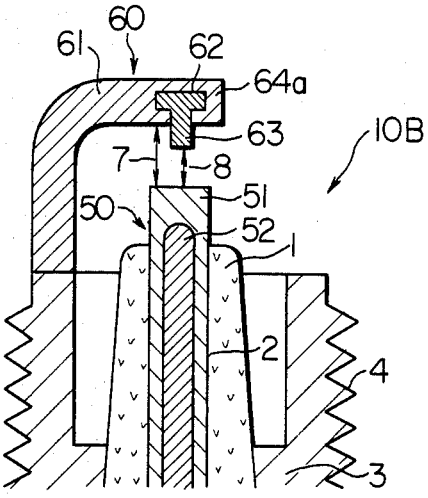
FIGS. 5A and 5B are fragmentary sectional views of a spark plug according to a third embodiment of the invention.
Figure 5B:
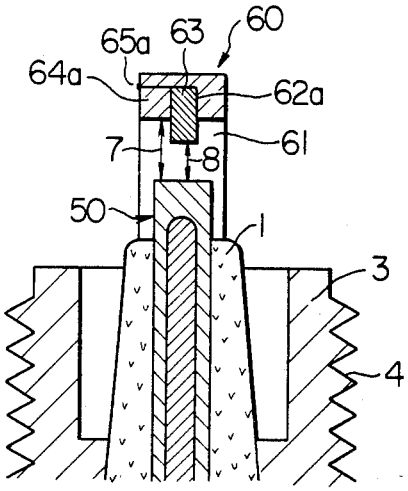

In FIGS. 5A and 5B, there is shown a spark plug 10B according to a third embodiment of the invention, which spark plug has the same construction as that of the spark plug 10A in FIGS. 2A and 2B except that a T-shaped groove 6*b* is formed on the side of the base portion 6*a*.

Figure 6A:
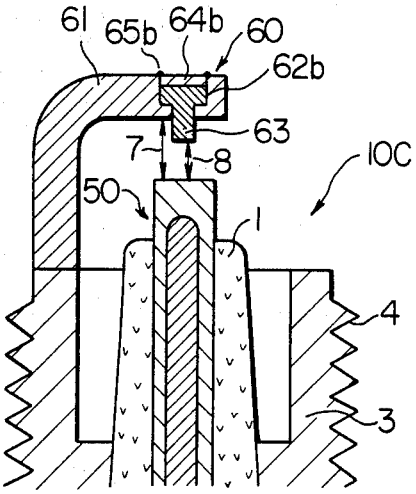
FIG. 6A is a fragmentary sectional view of a spark plug according to a fourth embodiment of the invention.
Figure 6B:
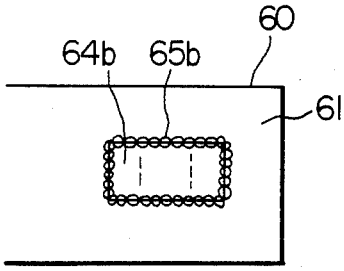
FIG. 6B is a plan view of a part of the spark plug of FIG. 6A.

In FIGS. 6A and 6B, there is shown a spark plug 10C according to a fourth embodiment of the invention, which spark plug has the same construction as that of the spark plug 10A of the second embodiment in FIGS. 2A and 2B except that a projection 63 is constructed in a manner as to be inserted into a T-shaped groove of the base portion 61 from thereabove.

Figure 7A:
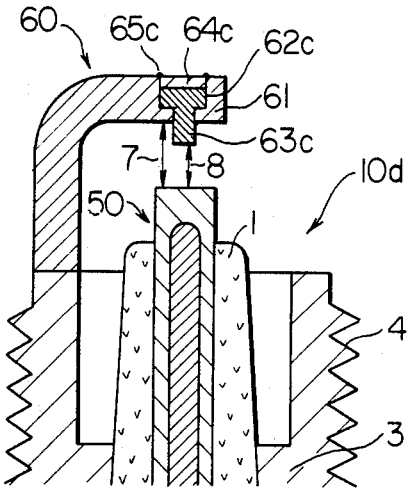
FIG. 7A is a fragmentary sectional view of a spark plug according to a fifth embodiment of the invention.
Figure 7B:
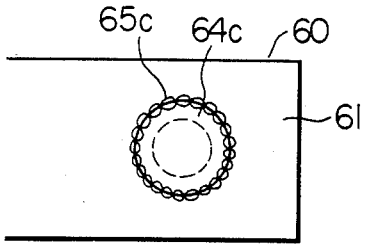
FIG. 7B is a plan view of a part of the spark plug of FIG. 7A.

In FIGS. 7A and 7B, there is shown a spark plug 10*d* according to a fifth embodiment of the invention, which spark plug has the same construction as that of the spark plug 10A except that a projection 63C is adapted to be inserted from above the base portion 61 and is made from a rod-like material to have a large diameter portion of 1.6 mm and a small diameter portion of 0.8 mm, for simplicity of manufacture.

Figure 8A:
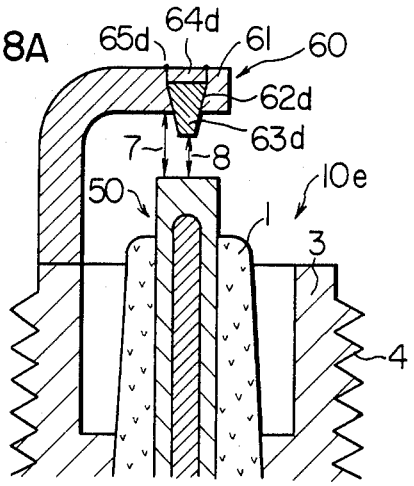
FIG. 8A is a fragmentary sectional view of a spark plug according to a sixth embodiment of the invention.
Figure 8B:
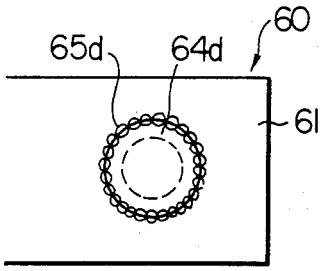
FIG. 8B is a plan view of a part of the spark plug of FIG. 8A.

In FIG. 8A and 8B, there is shown a spark plug 10*e* according to a sixth embodiment of the invention, in which a projection 63*d* is in the form of a frusto-cone and has, for example a small diameter of 0.8 mm and a large diameter of 1.4 mm.

Figure 9:
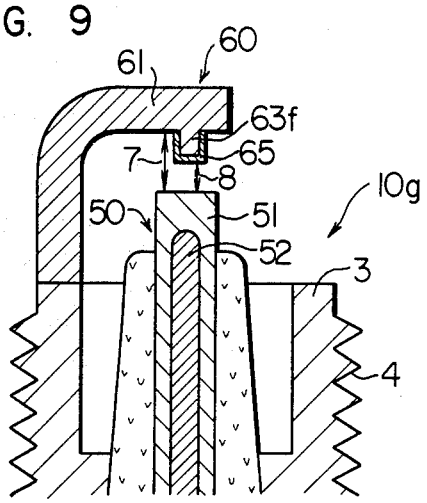
FIG. 9 is a fragmentary sectional view of a spark plug according to a seventh embodiment of the invention.

In FIG. 9, there is shown a spark plug 10*g* according to a seventh embodiment of the invention, in which a projection 6*c* is integrally formed on the base portion 61 and is covered by a coating of SiC by metallizing which has a higher specific resistance than that of the base portion 61.

Figure 10:
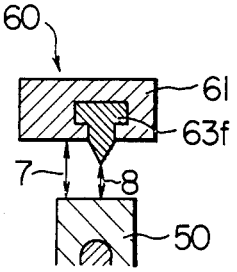
FIG. 10 is a fragmentary sectional view of the spark plug of the invention with a projection in modified form.
Figure 11A:
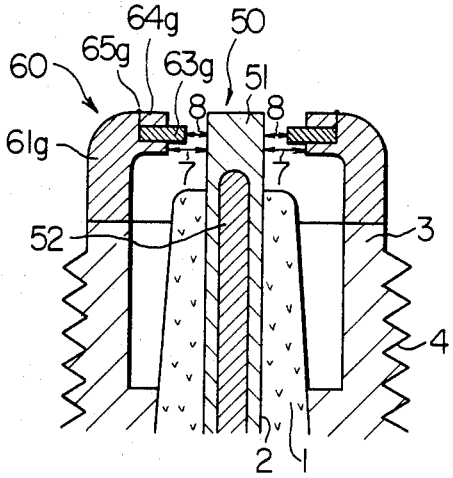
FIGS. 11A and 11B are views of a double-polar type spark plug according to the invention, FIG. 11A being a fragmentary sectional view thereof and FIG. 11B being a plan view thereof.
Figure 11B:
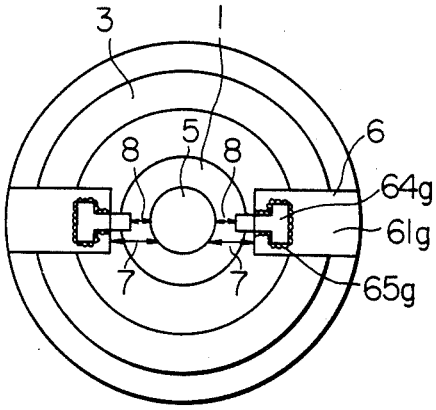

In the respective embodiments as shown in FIGS. 2A to 8B, the projection 63 is secured to the base portion 61 by inserting the member (64–64*d*) into the base portion 61 after insertion of the projection 63 into the base portion 61 and welding the member 64 to the base portion. Alternatively, the projection 6*c* may be secured to the base portion 61 by filling the T-shaped groove (62–62*d*) with weld padding after insertion of the projection 63 into the base portion 61 without using the member (64–64*d*). While the projection 63 is formed of SiC in the respective embodiments as shown in FIGS. 2A to 8B, it may be formed of other ceramics such as TiC, $BNZrB_2$, $HfB_2$, $TiB_2$, $Si_3N_4$, TiN or Ni-Cr alloy which have higher specific resistance than the material of the base portion. While the projection 6*c* for defining the small gap 8 has a plane surface at its tip end according to the embodiments as shown in FIGS. 2A to 8B, it may be in the form of wedge or pyramid or cone to present a pointed end, as shown in FIG. 10. Also, the earth electrode 60 may be multi-polar type such as double-polar or three-polar type, of which double-polar type is shown in FIGS. 11A and 11B.

Figure 12:
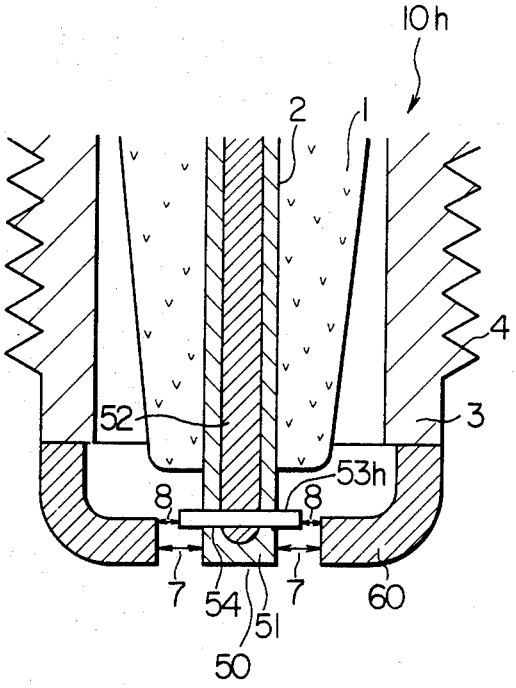
FIG. 12 is a fragmentary sectional view of a spark plug according to an eighth embodiment of the invention.

In FIG. 12, there is shown in part a spark plug 10*h* according to an eighth embodiment of the invention, which includes an insulator 1 made of alumina porcelain formed centrally thereof with an axial bore 1*a*, a housing 3 made of heat-resisting, anticorrosive, conductive metal and receiving therein said insulator 1, a central electrode 50 constituting the subject matter of the invention, and an earth electrode 60 made of Ni-Cr alloy and secured at its one end to the end surface of the housing 3 by welding. The housing 3 is formed with a threaded portion 4 for securing the same on the cylinder block of an internal combustion engine. The central electrode 50 comprises a base portion 51 made of a heat-resisting, anticorrosive, conductive Ni-Cr alloy, a core rod 52 made of good heat conductive copper for adjustment of thermal equivalent, and a projection 53*h* (herein below referred to as a complementary electrode 53*h*) made of a material, such as a rod material of SiC ceramic, having a higher specific resistance than that of the base portion 51. The projection or complementary electrode 53*h* may be made of other materials, such as TiC, BN, $ZrB_2$, $HfB_2$, $Zi_3N_4$, TiN and compounds thereof, having a higher specific resistance than that of the base portion 51. In this case, it is essential to use these materials a ceramic semiconductor having a specific resistance of $10^{-3}$ to $10^6$ $\Omega$ cm. The ceramic semiconductor may be mixed with such metals as Al, Fe and the like or conventional ceramics such as $Al_2O_3$ may be mixed with metals to provide the complementary electrode 53*h*. Alternatively, the complementary electrode 53*h* may be covered by a coating of a high specific resistance such that the electrode is consisted of Ni and the surface thereof is covered by a dense coating of $Al_2O_3$ or SiC. Furthermore, the base portion 51 of the central electrode 50 may be consisted of Ni with the complementary electrode 53*h* being consisted of Ni-Cr alloy having a higher specific resistance than that of Ni.

Figure 13:
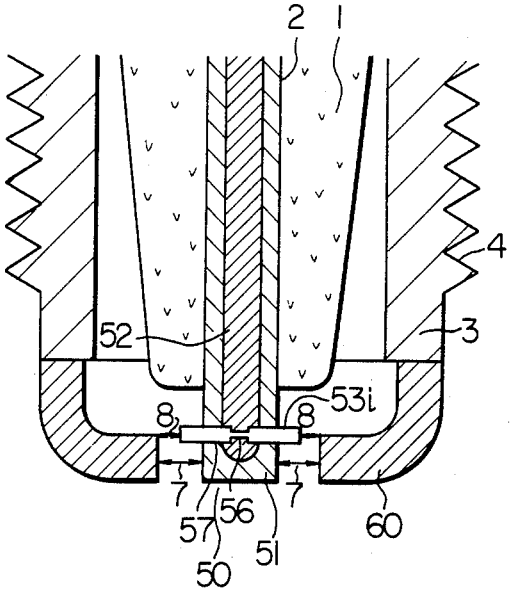
FIG. 13 is a fragmentary sectional view of the spark plug of FIG. 12 in a slightly modified form.

The base portion 51 has an outer diameter of 2.7 mm and receives therein said core rod 52 having an outer diameter of 1.8 mm. The base portion 51 is formed with a lateral bore 54, through which the complementary electrode 53*h* extends as well as through the core rod 52. Thus the central electrode 50 is secured to the insulator 1, and then the complementary electrode 53*h* having a length of 4.7 mm and an outer diameter of 1.0 mm is inserted into the lateral bore 54 and is fixed such that the respective ends thereof extend by 1 mm beyond the side surface of the base portion 51. The complementary electrode 53*h* may be in the form of a rod having a circular or rectangular cross-sectional shape. Fixing of the complementary electrode 53*h* into the bore 54 is performed by inserting the electrode into the bore 54, locally melting only the end portion of the core rod 52 in a vacuum atmosphere or in an atmosphere of inert gases, such as nitrogen gases, at temperatures of 1100° C. to 1200° C., above the melting point of the core rod 52 (1083° C. for copper) and below the melting point of the base portion 51 (1453° C. for Ni), and cooling the end portion of the core rod 52. The complementary electrode 53*h* may be secured to the central electrode 50 by other means such as screws, driving, caulking without melting the core rod 52. To ensure securement to the central electrode 50 the complementary electrode 53*i* may be provided centrally with a groove 56, as shown in FIG. 13, which is filled with Cu when the core rod 52 is melted. The earth electrodes 60 are bent at their intermediate portions toward the central electrode 50 such that the tip ends of the earth electrodes face the complementary electrode 53*i* and the side surfaces of the base portion 51 to produce therebetween a small gap 8 of 0.5 mm and a large gap of 1.5 mm. The earth electrode 60 may be one, three or four in number.

With the central electrode 50 thus formed, the base portion 51 has a specific resistance of 5 to 10 $\mu\Omega$ cm, and the complementary electrode 53*h* has a specific resistance of $10^{-3}$ to $10^{6}$ $\Omega$ cm.

In operation, a high electric voltage is applied between the central electrode 50 and the housing 3 by an ignition coil to produce a breakdown at the small gap 8 and a discharge spark between the complementary electrode 53*h* and the earth electrode 60. The electric voltage required for production of breakdown is ten or more KV. After breakdown there is maintained electric discharge at several hundreds volts which rapidly moves to the large gap 7 since the specific resistance of the base portion 51 is smaller than that of the complementary electrode 53*h* to facilitate maintaining the electric discharge. The large gap 7 is located nearer the outside, that is, the combustion chamber, than the small gap 8, so that a flame core produced at the large gap 7 becomes liable to contact with the mixture of fuel and air, thereby improving ignition characteristics.

Figure 14:
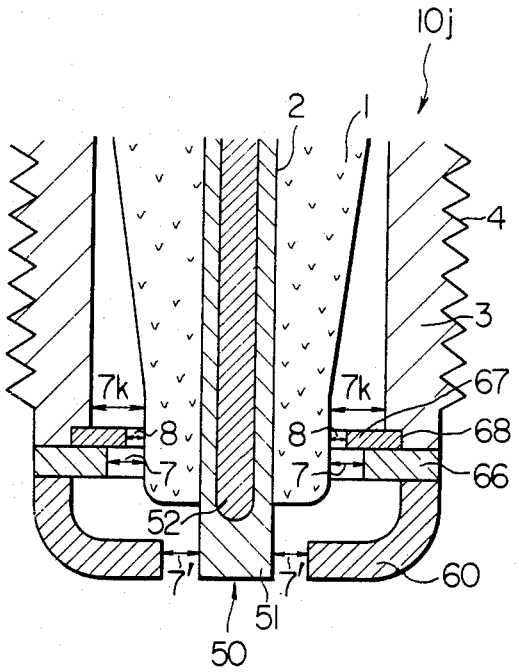
FIG. 14 is a fragmentary sectional view of a spark plug according to a ninth embodiment of the invention.

In FIG. 14, there is shown in part a spark plug 10*j* according to a ninth embodiment of the invention, which includes an insulator 1 formed with an axial bore 2, a central electrode 50, a housing 3 provided with a threaded portion 4, an earth electrode 60, a supplementary electrode 67 for a small gap 8, and a second supplementary electrode 66 for a large gap 7. These supplementary electrodes are overlapped on each other such that the ends are stepped. There is provided a small gap 8 between the insulator 1 and the supplementary electrode 67, and there is provided a large gap 7 between the insulator 1 and the supplementary electrode 66. There is also provided a gap 7*k* between the inner surface of the housing 4 and the insulator 1.

These gaps have a dimensional relationship which is represented by an inequality $8<7<7k$. In this embodiment, a=1.1 mm, c=0.5 mm, d=1.0 mm, and e=1.6 mm. The supplementary electrode 67 for a small gap is made of a ceramic semiconductor, such as SiC, having a specific resistance of 1 to $10^{3}$ $\Omega$ cm. Alternatively, the electrode 67 may be made of other ceramics, for example, TiC, BN, $ZrB_2$, $HfB_2$, $Si_3N_4$, TiN and other compounds thereof, having a higher specific resistance than that of the second supplementary electrode 66. In this case it is essential to use so-called semiconductor having a specific resistance of $10^{-3}$ to $10^{6}$ $\Omega$ cm. Also, alloys having large specific resistances are serviceable.

The second supplementary electrode 66 for a large gap is made of Ni-Cr alloy having good heat resistance, anticorrosiveness and a specific resistance of about 5 to 10 $\mu\Omega$ cm.

The supplementary electrode 67 for a small gap is annular-shaped and is fitted in a groove 68 formed in the housing 3. The second supplementary electrode 66 for a large gap is also annular-shaped and is secured to the housing 3 by welding after the insertion of the supplementary electrode 67 into the groove 68. The earth electrode 60 is secured to the second supplementary electrode 67 by welding. Alternatively, the electrodes 67 and 66 may be formed integral with the housing 3 and only the surface of the electrode 67 may be covered by a material, such as a coating of SiC, having a high specific resistance.

With the arrangement as described above, spark discharge occurs when the insulation resistance between the central electrode 50 and the earth electrode 60 is reduced under sooty conditions to the extent that any spark discharge can not occur at the normal spark gap 7'. Thus breakdown firstly occurs at the small gap 8 to burn up carbon adhered to the surface of the supplementary electrode 67, and induction discharge after the occurrence of breakdown spreads to locations where resistance value is low since the specific resistance of the supplementary electrode 67 for the small gap 8 is high. However, induction discharge moves to the supplementary electrode 66 for the large gap 7 disposed adjacent the combustion chamber instead of moving to the inner surface of the housing 3 since electric discharge can be conveniently maintained where distances are small between the gaps. In order to cause induction discharge to move to the large gap 7, the respective electrodes are arranged such that the distances between the respective electrodes satisfy the inequality $8<7<7k$.

Figure 15:
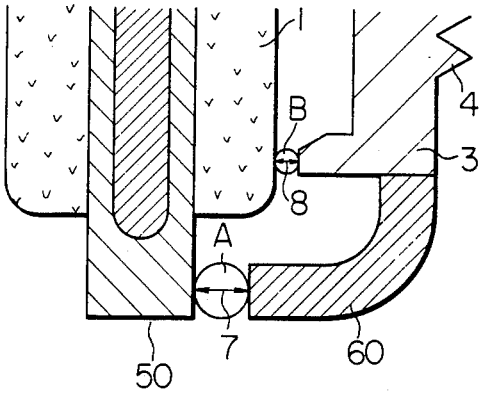
FIG. 15 PRIOR ART
FIG. 15 is a fragmentary sectional view of a prior spark plug.
Figure 16:
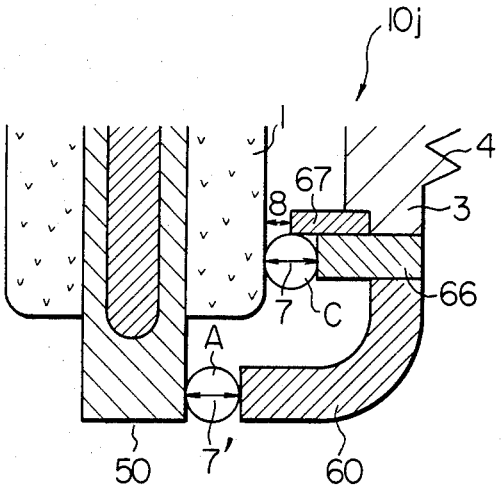
FIG. 16 is a fragmentary sectional view of the spark plug of FIG. 14.

The effects provided by this embodiment are explained hereinbelow with reference to FIGS. 15 and 16. In FIG. 15, there is shown a prior spark plug in which a flame core B produced at a supplementary gap 8 is very small as compared with a flame core A produced at a normal gap 7. On the other hand, the case with the embodiment of the present invention is such that a flame core C becomes large as compared with the flame core B of the prior art since breakdown occurs at the small gap 8 under sooty conditions and thereafter induction discharge occurs at large gap 7 with the result that the mixture of fuel and air is surely ignited and variation in combustion becomes stationary.

Figure 17:
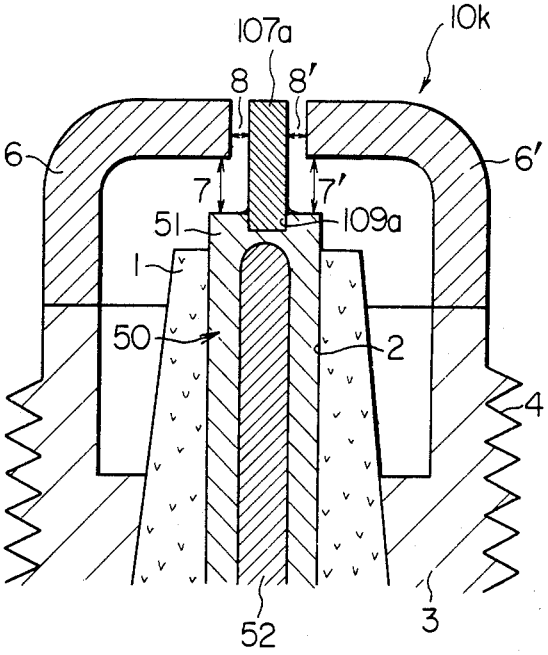
FIG. 17 is a fragmentary sectional view of a spark plug according to a tenth embodiment of the invention.

In FIG. 17, there is shown in part a spark plug 10*k* according to a tenth embodiment of the invention, which includes an insulator 1 made of alumina porcelain formed centrally thereof with an axial bore 2, a housing 3 made of heat-resisting, anticorrosive, conductive metal and securedly receiving therein said insulator 1, a central electrode 50 constituting the subject matter of the invention, and earth electrodes 6, 6' made of Ni and secured at its lower end to the end of the housing 3 by welding. The housing 3 is formed with a threaded portion 4 for securing the same on the cylinder block of an internal combustion engine. The central electrode 50 comprises a base portion 51 made of Ni, a tip electrode 107*a* made of an alloy Ni-Cr, and a core rod 52 made of a good heat conductive copper for adjustment of thermal equivalent. The base portion 51 is of 25 mm in outer diameter, and receives therein the core rod 52 having an OD of 1.6 mm. The tip electrode 107*a* is in the form of a round bar having a length of 3.5 mm and an OD of 1 mm, and the inner end portion thereof is embedded by 0.5 mm in a counterbore 109*a* formed in the end of the base portion 51 and secured thereto by welding. The earth electrodes 6, 6' are bent at their middle portions toward the central electrode 50 with the ends thereof facing the side surfaces of the tip electrode 107*a*. There are defined discharge gaps 8, 8' of 0.5 mm in thickness between the side surfaces of the tip electrode 107*a* and the earth electrodes 6, and there also are defined discharge gaps 7, 7' of 1.5 mm in thickness between the end surface of the base portion 51 of the central electrode 50 and the facing surfaces of the respective earth electrodes 6, 6'.

With the central electrode 50 thus constituted, the base portion 51 has a specific resistance of 5 to 10 $\mu\Omega$ cm, and the tip electrode 107*a* has a specific resistance of 100 to 200 $\mu\Omega$ cm. When a high electric voltage is applied between the central electrode 50 and the housing 3 by an ignition circuit externally of the ignition plug, breakdown occurs at the gap 8 or the gap 8' to produce discharge spark between the tip electrode 107*a* and the earth electrode 6 or 6'. The voltage required for causing breakdown is ten or more KV. After the occurrence of breakdown, electric discharge is maintained at several hundreds volts, and is rapidly propagated to the gap 7 or 7' since the base portion 51 has a smaller specific resistance than that of the tip electrode 107*a*, thus readily maintaining electric discharge.

Figure 18:
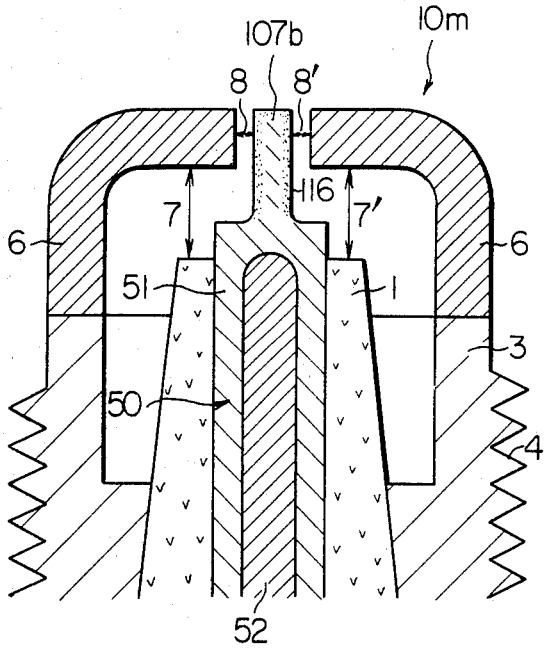
FIG. 18 is a fragmentary sectional view of a spark plug according to an eleventh embodiment of the invention.

In FIG. 18, there is shown in part a spark plug 10*m* according to an eleventh embodiment of the invention, in which a base material of Ni integrally constitutes a base portion 51 and a tip electrode 107*b* of a central electrode 50. Cr is diffused into the surface of the tip electrode to form a portion 116 of Ni-Cr alloy thereon. Thus the tip electrode 107*b* has a higher specific resistance than that of the base portion 51, so that the spark plug 10*m* functions in substantially the same manner as the spark plug 10*k* according to the tenth embodiment of the invention.

Figure 19:
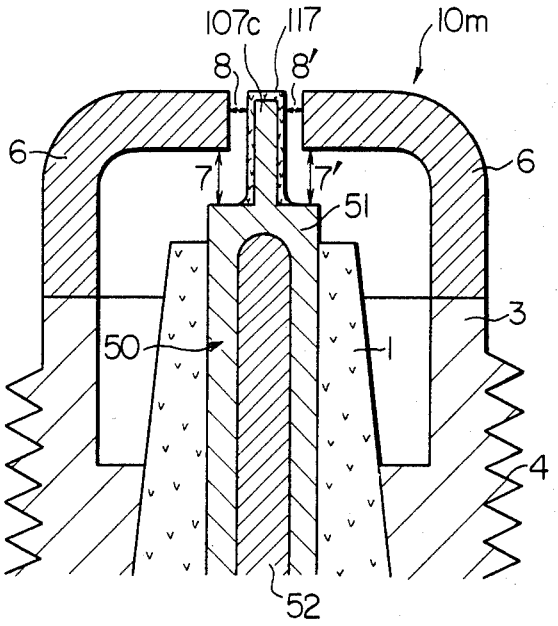
FIG. 19 is a fragmentary sectional view of a spark plug according to a twelfth embodiment of the invention.

In FIG. 19, there is shown in part a spark plug 10*n* according to a twelfth embodiment of the invention, in which a base portion 51 and a small diameter tip electrode 107*c* are formed integral with each other. The tip electrode 107*c* only is covered by a porous coating 117 formed of a ceramic such as $Al_2O_3$, which coating is formed by metallizing.

Figure 20:
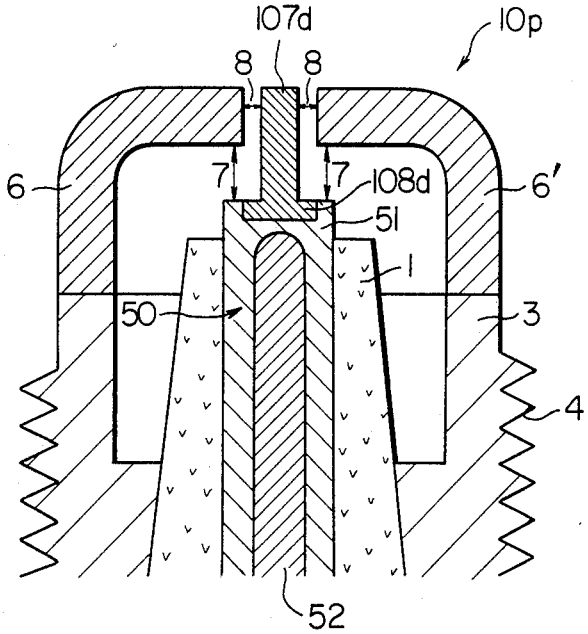
FIG. 20 is a fragmentary sectional view of a spark plug according to a thirteenth embodiment of the invention.

In FIG. 20, there is shown in part a spark plug 10*p* according to a thirteenth embodiment of the invention, in which a tip electrode 107*d* formed of Ni-Cr alloy includes a flange portion 108*d* secured to a base portion 51 in flush relationship therewith. Thus the arrangement facilitates propagation of spark discharge from an end portion to the flange portion of the tip electrode 107*d*, thereby improving ignition characteristics of the spark plug.

In the respective embodiments as shown in FIGS. 17 to 20 the earth electrodes 6, 6' are opposed to the side surface (cylindrical surface) of the tip electrode 107. However, the earth electrodes may be opposed to the end surface of tip electrode 107.

Figure 21:
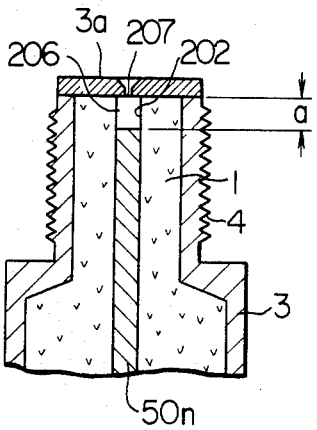
FIG. 21 PRIOR ART
FIG. 21 is a fragmentary sectional view of a prior spark plug.
Figure 22:
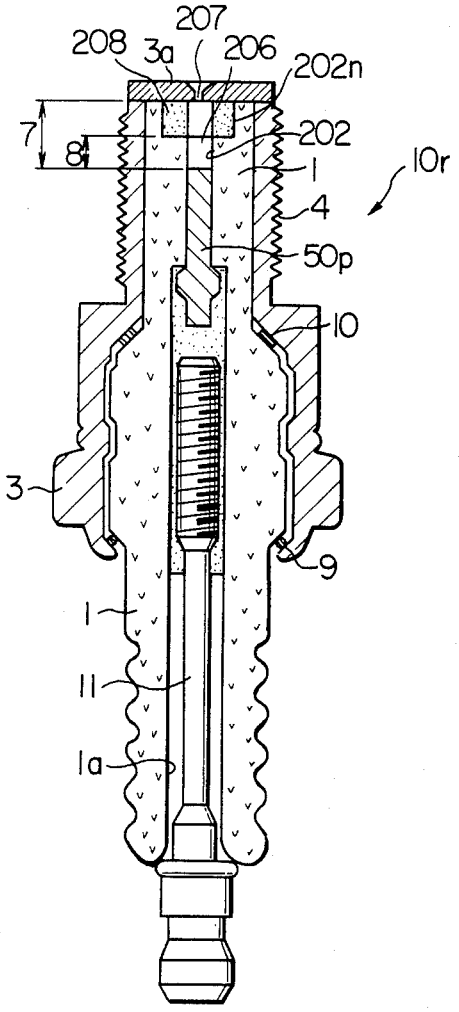
FIG. 22 is a vertical sectional view of a spark plug according to a fourteenth embodiment of the invention.

In FIG. 22, there is shown a spark plug 10*r*, for use with spark ignition type internal combustion engines, according to a fourteenth embodiment of the invention, which includes an insulator 1 made of alumina porcelain ($Al_2O_3$) formed centrally thereof with an axial bore 2 for receiving a terminal shaft 11, a housing 3 made of heat-resisting, anticorrosive, conductive metal, a central electrode 50*p* made of Ni and received in the axial bore 2 of the insulator 1, a disk-shaped earth electrode 3*a* welded to the end of the housing 3, and an annular-shaped supplementary electrode 208 made of sintered silicone carbide. The insulator 1 is mounted in the housing 3 by using a packing 10 and a clamping ring 9. The housing 3 is formed with a threaded portion 4 which serves to secure the same on the cylinder block of an internal combustion engine and to electrically ground the same. The insulator 1 is counterbored at its end and the tip end of the central electrode 50*p* is disposed inwardly back by about 2 mm from the bottom surface of the counterbore. The insulator 1 is flush at its end surface with the end of the housing 3. The electrode 3*a* is formed centrally with a conical-shaped port 207 which is coaxial with the central electrode 50*p* and has a diameter of 1 mm at its small portion. The annular-shaped supplementary electrode 208 is fitted in the counterbore of the insulator 1 and is covered by the earth electrode 3*a*. The supplementary electrode 208 has a specific resistance of $10^{-3}$ to $10^{6}$ $\Omega$ cm, and is about 3 mm in thickness. The bore of the supplementary electrode 208 is of the same diameter as that of the axial bore 2 of the insulator 1 to provide a columnar-shaped chamber 206 which is of about 5 mm in axial length and is defined by the end surface of the central electrode 50*p*, the underside of the earth electrode 3*a*, the inner surface of the axial bore 2 and the bore of the annular-shaped supplementary electrode 3*a*. Thus it will be appreciated that the columnar-shaped chamber 206 in the present invention is large in axial length as compared with a chamber of a prior ignition plug (FIG. 21) which is defined only by an end surface of a central electrode, an underside of an earth electrode and an axial bore of an insulator.

In operation, breakdown is caused to commence spark discharge at a gap 8 defined between the tip end of the central electrode 50*p* and the lower end of the supplementary electrode 208 when a high electric voltage is applied to the central electrode 50*p*. The voltage required for causing such breakdown is determined by the length of the small gap 8 which length is set at the same magnitude as that of a gap a, that is, a columnar chamber of a prior spark plug of FIG. 21, so that the voltage is the same as that for a prior spark plug. After breakdown occurs at the small gap 8, spark discharge continues to be gradually moved to the earth electrode 3*a* since the supplementary electrode 208 has an large electric resistance. Consequently, the spark discharge grows into spark discharge at a large gap 7 having a length of about 5 mm between the tip end of the central electrode 50*p* and the earth electrode 3*a*.

Figure 23:
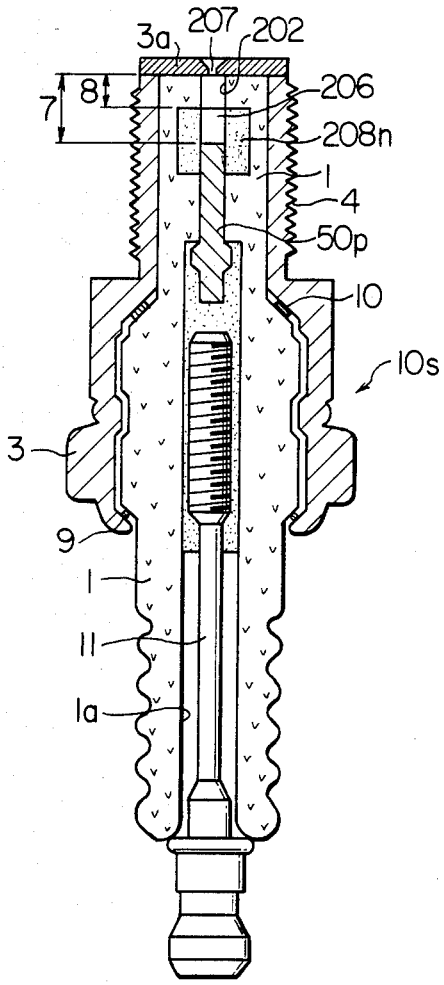
FIG. 23 is a vertical sectional view of a spark plug according to a fifteenth embodiment of the invention.

In FIG. 23, there is shown an ignition plug 10*s* according to a fifteenth embodiment of the invention, in which an annular-shaped supplementary electrode 208*n* is beforehand formed of SiC as sintered, and is placed in a die or mould for an insulator 1 to thereby be attached to the inner surface thereof such that the supplementary electrode 208*n* is in contact with a central electrode 50*p*. Accordingly, a small gap 8 is defined between the tip end of the supplementary electrode 208*n* and the inner end of the earth electrode 3*a* to have a length of about 2 mm. Thus the small gap 8 is disposed near a port 207 of the electrode 3*a* to permit a rich mixture of fuel and air to enter the small gap 8, thereby producing plasma advantageously and efficiently.

In the respective embodiments as shown in FIGS. 22 and 23, the supplementary electrode 208 is formed by SiC, but may be made in other manners. More specifically, the electrode 208 may be formed of such ceramic semiconductors as TiC, CrCm, WC, MoC, $B_4C$, MoSi or these ceramic semiconductors mixed with heat-resistant ceramic materials such as $Al_2O_3$, $Cr_2O_3$ or these ceramic semiconductors mixed with such metals as Cr, Ni, Co, Fe, Al or ceramic consisting of a mixture of heat-resisting ceramic materials such as $Al_2O_3$ and the metals as described above. Alternatively, the supplementary electrode 208 may be made by partly adding the aforementioned materials to electrical porcelain during the moulding of the insulator 1 and baking the resulting product. Alternatively, the supplementary electrode 208 may be made by having the aforementioned materials saturated into the insulator 1 as moulded and baking the resulting product. Alternatively, the supplementary electrode 208 may be made by separately moulding the insulator 1 and supplementary electrode 208 of the aforementioned materials, joining the both elements as moulded and baking the resulting product. The supplementary electrode 208 can be formed of metals. For example, the supplementary electrode 208 is formed of Ni-Cr alloy having a larger specific resistance than that of Ni of which the earth electrode 3*a* is formed. Thus the earth electrode 3*a* and the supplementary electrode 208 can be formed of different metals having different specific resistances, respectively.

It is intended that the foregoing be merely a description of preferred embodiments and that the invention be limited solely by that which is within the scope of the appended claims.

What is claimed is:

1. In a spark plug for spark ignition type internal combustion engines, including an earth electrode formed of a heat-resisting and electrically conductive material and a central electrode, the improvement comprising: a supplementary electrode electrically connected to one of said earth and central electrodes, the tip end of said supplementary electrode extending in facing relationship with the other of said earth and central electrodes, at least the surface portion of said supplementary electrode being formed of an electrically conductive ceramic having a specific resistance in the range of $10^{-3}$ Ω.cm to $10^{6}$ Ω.cm, the tip end of said supplementary electrode cooperating with said other electrode to define therebetween a gap of smaller dimension than that of the gap between said earth and central electrodes.

2. A spark plug as set forth in claim 1 wherein said supplementary electrode comprises a projection provided on a base portion of said earth electrode in opposed relation to said central electrode.

3. A spark plug as set forth in claim 1 wherein said electrically conductive ceramic is formed of a material selected from a group which includes SiC alone, TiC plus $Al_2O_3$, TiC plus $Cr_2O_3$ and WC plus $Cr_2O_3$.

4. A spark plug as set forth in claim 1 wherein said central electrode comprises a rod body formed of a heat-resisting metal and a reduced-diameter tip formed of electrically conductive ceramic having higher heat-resistance and higher electric resistance than those of said rod body, said tip constituting said supplementary electrode.

5. A spark plug as set forth in claim 4 wherein said rod body is cylindrical-shaped and is filled with a heat-conductive metal.

6. A spark plug as set forth in claim 2 wherein the surface portion comprises a ceramic coating which is formed integral with the base portion of said earth electrode.

7. A spark plug as set forth in claim 2 wherein said projection in itself is formed of electrically conductive ceramic having a specific resistance in the range of $10^{-3}$ Ω.cm to $10^{6}$ Ω.cm.

8. A spark plug as set forth in claim 2 wherein the tip end of said projection has a smaller area of projection than the surface of said central electrode which faces the tip end of said projection.

9. A spark plug as set forth in claim 2 wherein said earth electrode has a specific resistance in the range of 5 μΩ.cm to 10 μΩ.cm.

10. In a spark plug including a central electrode supported by an insulator and having its end extending beyond said insulator, and an earth electrode disposed in opposed relation to a side of said end, the improvement comprising: said earth and central electrodes being formed of electrically conductive metals, a projection extending laterally from said end of said central electrode and having a higher specific resistance than that of said central electrode and being formed of an electrically conductive ceramic having a specific resistance in the range of $10^{-3}$ Ω.cm to $10^{6}$ Ω.cm, said projection cooperating with said earth electrode to define a small gap therebetween, and wherein a gap larger than said small gap is defined between said earth electrode and said end of said central electrode.

11. A spark plug as set forth in claim 10 wherein said small gap is located nearer to the end surface of said insulator than said large gap.

12. A spark plug as set forth in claim 10 or 11 wherein said projection is formed of silundum.

13. A spark plug as set forth in claim 10 or 11 wherein said projection is of metal covered by a coating of a high specific resistance.

* * * * *